US007059863B2

(12) United States Patent
Ma

(10) Patent No.: US 7,059,863 B2
(45) Date of Patent: Jun. 13, 2006

(54) PICK UP CAP AND LGA CONNECTOR ASSEMBLY WITH PICK UP CAP

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,870

(22) Filed: Nov. 19, 2004

(65) Prior Publication Data

US 2005/0112922 A1 May 26, 2005

(30) Foreign Application Priority Data

Nov. 21, 2003 (TW) ..... 92220601 U

(51) Int. Cl.
*H01R 13/60* (2006.01)

(52) U.S. Cl. ..... 439/41; 439/331; 439/940

(58) Field of Classification Search ..... 439/331, 439/41, 135, 940, 142
See application file for complete search history.

(56) References Cited

U.S. PATENT DOCUMENTS

| | | | | |
|---|---|---|---|---|
| 2003/0114036 | A1* | 6/2003 | Yu | 439/342 |
| 2004/0097104 | A1* | 5/2004 | Zhang | 439/41 |
| 2005/0014401 | A1* | 1/2005 | Ma et al. | 439/135 |
| 2005/0090136 | A1* | 4/2005 | Liao et al. | 439/331 |
| 2005/0136711 | A1* | 6/2005 | Ma | 439/135 |

* cited by examiner

*Primary Examiner*—Chandrika Prasad
(74) *Attorney, Agent, or Firm*—Wei Te Chung

(57) ABSTRACT

A pick up cap for LGA connector, the LGA connector has an insulative housing for receiving an electronic package such as CPU therein, a plurality of electrical contacts received in the housing. A clip disposed on the housing to press the CPU upon the contacts, and a pick up cap mounted on the clip. One detaching portion extends in a slantwise upward direction from one end of an extending portion, between said detaching portion and one side of said clip, there is a relatively broad rift which can supplies a sufficient operating place for an operator's fingertip to remove the pick up cap.

20 Claims, 4 Drawing Sheets

PICK UP CAP AND LGA CONNECTOR ASSEMBLY WITH PICK UP CAP

BACKGROUD OF THE INVENTION

1. Field of the Invention

The present invention relates to a land grid (LGA) connector assembly which has an LGA connector and a pick up cap being mounted to the connector for provision of a smooth flat top surface for being sucked by a vacuum suction device, thereby facilitating mounting the LGA connector assembly onto a substrate circuit such as a printed circuit board (PCB).

2. Description of the Prior Art

On many mass production lines, vacuum suction devices are often used to suck electronic components such as LGA connectors, and then position the connectors on substrate circuits such as printed circuit boards PCBs. An LGA connector typically has an insulative housing, a plurality of electrical contacts received in the housing, a metal clip pivotably mounted to an end of the housing, and a lever pivotably mounted to an opposite end of the housing for engaging with the clip. The clip has four sides and a generally rectangular window in a middle thereof. In order to suck and position the LGA connector on a substrate circuit, the pick up cap is often pre-attached on a top portion of the connector. The pick up cap is a substantially rectangular plate having two extending portions extending coplanarly from two opposite sides thereof, and several latches and claps set on the other opposite two sides thereof. when the pick up cap is mounted on the clip, the latches and clasps snap corresponding two opposite sides of the clip and the two extending portion engage with the other two opposite sides of the clip, thereby attaching the pick up cap to the LGA connector. The pick up cap has a smooth flat top surface. The vacuum suction device is able to suck the flat top surface of the pick up cap, and reliably move and accurately position the LGA connector onto the PCB. After the LGA connector has been correctly mounted onto the PCB, the pick up cap will be detached from the connector, the definite procedure is that one operator extends one of his fingertip into a small rift between one extend portion and one side of the clip to detach the pick up cap away from the connector.

However, the operation of detaching the pick up cap from the connector may encounter some problems due to the rift, which is so small and unobvious and can not afford a sufficient operating place for being manipulated by an operator with his fingertip. Moreover operator may even attempt to detach the pick up cap by manipulating a wrong place, not exact the rift between one extend portion and one side of the clip. This often causes damage to the connector or the pick up cap.

Therefore, a new pick up cap that overcome above-mentioned disadvantages is desired.

SUMMARY OF THE INVENTION

Accordingly, an objective of the present invention is to provide a pick up cap for an LGA connector assembly, wherein the pick up cap has minimal risk of damaging the connector while the pick up cap is being detached from the connector.

To achieve the above-mentioned objective, an. LGA connector assembly in accordance with a preferred embodiment of the invention has an LGA connector and a pick up cap. The connector has an insulative housing, a plurality of electrical contacts received in the housing, and a metal clip. The housing defines a generally rectangular cavity for receiving an electronic package such as an LGA central processing unit (CPU) therein. The clip is disposed on the housing to press the CPU upon the contacts. The clip defines a rectangular window in the middle thereof. Around the window are two opposite ends and two opposite sides. The pick up cap is generally rectangular, and has a plurality of clasps and latches set at two opposite ends thereof, two extending portions extend coplanarly from two other opposite ends respectively. When the pick up cap is mounted onto the connector, the clasps and latches snap the inner edges of two opposite ends of the clip, and the two extending portions engage the two opposite sides of the clip firmly. Therefore, the pick up cap is securely mounted onto the connector. One detaching portion extends in a slantwise upward direction from one end of an extending portion, between said detaching portion and one side of said clip, there is a relatively broad rift which can supplies a sufficient operating place for an operator's fingertip to remove the pick up cap. The pick up cap provides a smooth flat top surface to be sucked by a vacuum suction device, thereby manipulating the LGA connector assembly onto a pre-determined location of a substrate circuit. When the pick up cap is to be detached from the connector, the operator extends one of his fingertips under said detaching portion firstly, and then uplift said detaching portion easily and safely to detach the pick up away from the connector.

Other objectives, advantages and novel features of the invention will become more apparent from the following detailed description when taken in conjunction with the accompanying drawings.

DRIEF DESCRIPTION OF THE DRAWINGS

DETAILED DESCRIPTION OF THE PREFERRED EMBODIMENT OF THE INVNETION

Reference will now be made to the drawings to describe the present invention in detail.

Figure 1:
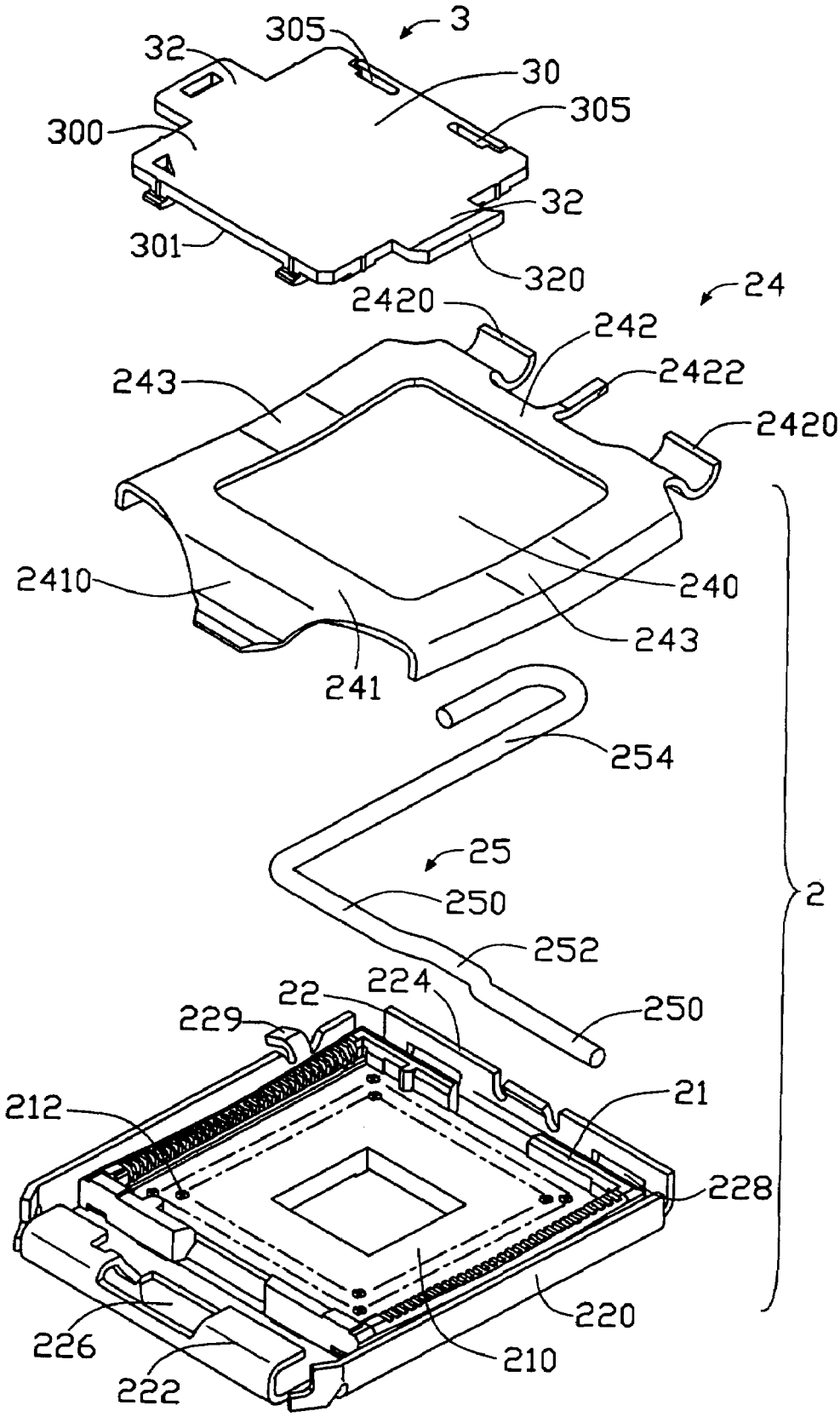
FIG. 1 is an exploded, isometric view of an LGA connector assembly of the present invention, the LGA connector assembly having an LGA connector and a pick up cap to be mounted onto the connector.

FIG. 1 shows an exploded, isometric view of a land grid array (LGA) connector assembly in accordance with a preferred embodiment of the present invention. The LGA connector assembly has an LGA connector 2 and a generally rectangular pick up cap 3. The pick up cap 3 is mounted onto the connector 2 for provision of a flat top surface 30 to be sucked by a vacuum suction device, thereby facilitating manipulating the LGA connector assembly onto a substrate circuit, such as a PCB (not shown), on which the connector 2 is seated.

The connector 2 has a generally rectangular insulative housing 21, a plurality of electrical contacts (not shown) received in the housing 21, a metal stiffener 22 partly covering the housing 21 to enforce the housing 21, a lever 25 pivotably received in an end of the stiffener 22, and a metal clip 24 pivotably mounted onto an opposite end of the stiffener 22, during rotating, the lever 25 can press downwardly upon the metal clip 24.

Figure 4:
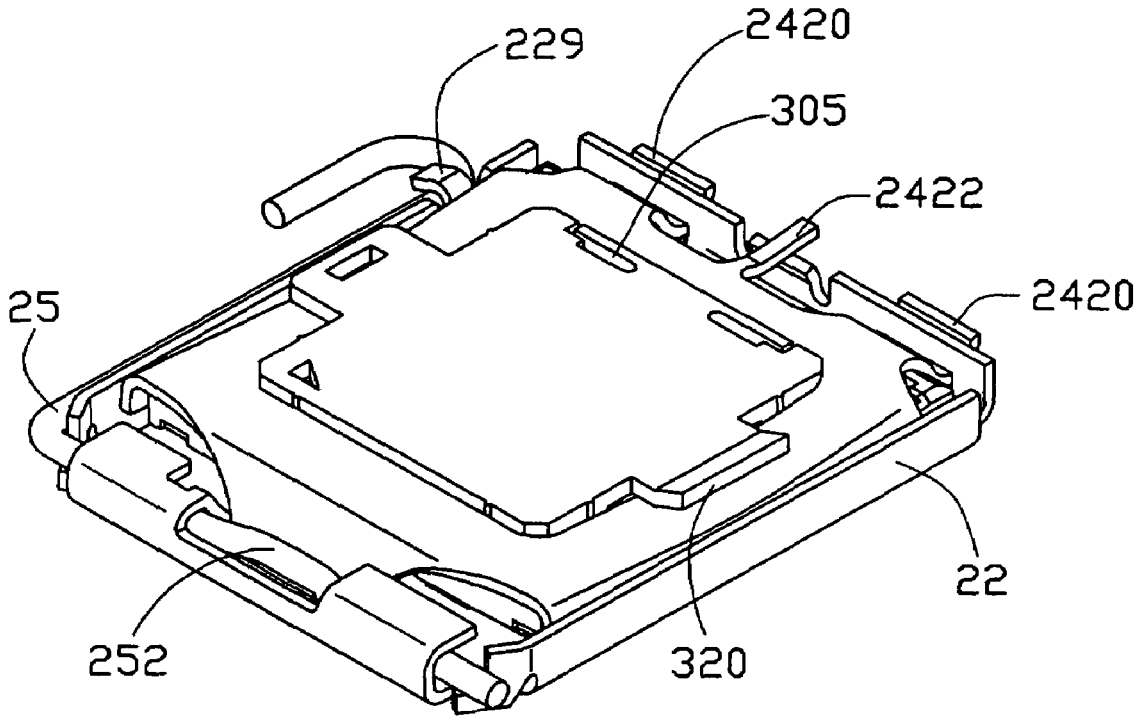
FIG. 4 is an assembled, isometric view of the LGA connector assembly of FIG. 1.

FIG. 4 is an assembled view of the connector 2 and the pick up cap 3. Please refer to FIG. 4 together with FIG. 1, the housing 21 defines a generally rectangular cavity 210 in a middle thereof. The cavity 210 is used for receiving an electronic package such as an LGA CPU (not shown) therein. A multiplicity of passageways 212 are defined in a portion of the housing 21 under the cavity 210, the passageways 212 receiving a corresponding number of contacts (not shown) therein. The stiffener 22 has a pair of L-shaped cross-sectional lateral sides 220, and a U-shaped cross-sectional front end 222 and a L-shaped cross-sectional rear end 224 interconnecting two opposite ends of the lateral sides 220 respectively. The housing 21 is received in a middle portion of the stiffener 22. An elongate chamber 226 is defined in an end of the stiffener 22, a pair of spaced slots 228 is defined in another end of the stiffener 22. An ear 229 extends bendly from an edge of one L-shaped cross-sectional lateral sides 220. The lever 25 has a pair of locating portion 250 pivotably received in the chamber 226 of the stiffener 22, an actuating portion 252 between the locating portions 250, and an operating portion 254 extending perpendicularly from an end of one of the locating portions 250. The operating portion 254 is disposed at an outside of the stiffener 22, and engages with the ear 229 when the operating portion 254 is oriented at a horizontal position. The clip 24 defines two opposite ends 241, 242 and two opposite urging sides 243 interconnecting the two ends 241, 242. Two opposite ends 241, 242 together with two opposite urging sides 243 exclosure a rectangular window 240. the middle portion of the two opposite urging sides 243 bends downwardly. The clip 24 has an engaging portion 2410 extending arcuately from the front end 241 thereof, a pair of spaced securing portions 2420 extending arcuately from the rear end 242 thereof corresponding to the slots 228 of the stiffener 22, and a tail 2422 between the securing portions 242. The securing portions 242 are pivotably received in the slots 228 of the stiffener 22. When the operating portion 254 is being rotated towards the ear 229, the actuating portion 252 urges engaging portion 240 of the clip 24, then the middle portion of the urging sides 243 will urge CPU to engage with the contacts of the connector. When the clip 24 is oriented at a position perpendicular to the top portion of the housing 21, the tail 244 abuts against the stiffener 22 to prevent the clip 24 from continuous rotation.

The pick up cap 3 has a generally rectangular planar body 30. The planar body 30 defines a smooth flat top surface 300 and a bottom surface 301 opposite to the top surface 300. Two extending portions 32 extend respectively from two opposite ends of the planar body respectively. One of the two extending portion 32 forms a detaching portion 320 which extends in a slantwise upward direction from the end of the extending portion 32.

Figure 2:
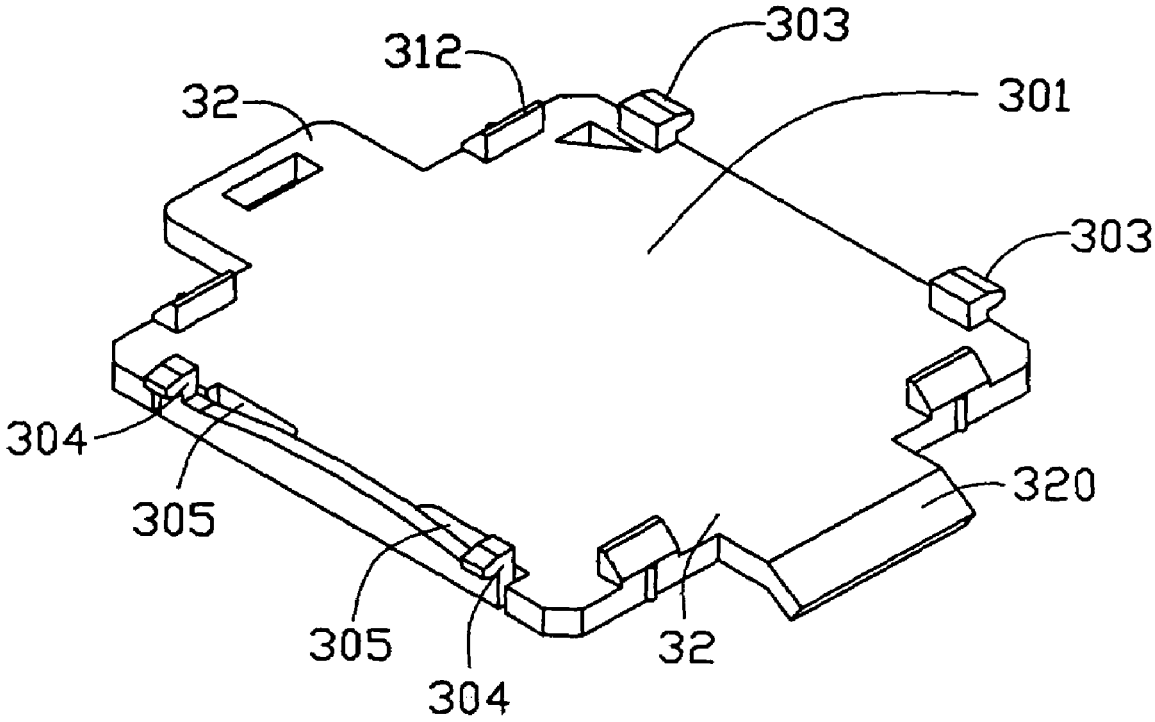
FIG. 2 is an inverted, isometric view of the pick up cap of FIG. 1.

FIG. 2 shows a bottom side view of the pick up cap 3. Four stops 312 are respectively arranged near the four corners of pick up cap 3. The four stops 312 are aimed to restrain the pick up cap 3 from moving on the connector 2. A pair of clasps 303 is formed at one end of the pick up cap 3. Each clasp 303 extends perpendicularly from the bottom surface 301 of the planar body 30 and then bends laterally for snapping one inner side of the front end 241 of the clip 24. Opposite to the two clasps 303, a pair of latches 304 extends perpendicularly from another side of the bottom surface 301 of the planar body 30. The two latches 304 are designated to snap another inner side of the rear end 242 of the clip 24. Nearby each latch 304, there is a slot 305 defined in one end of the pick up cap 3. With the two slot 305, the two latch 304 can be elastically deflected to facilitate mounting the pick up cap 3 to the connector 2.

Figure 3:
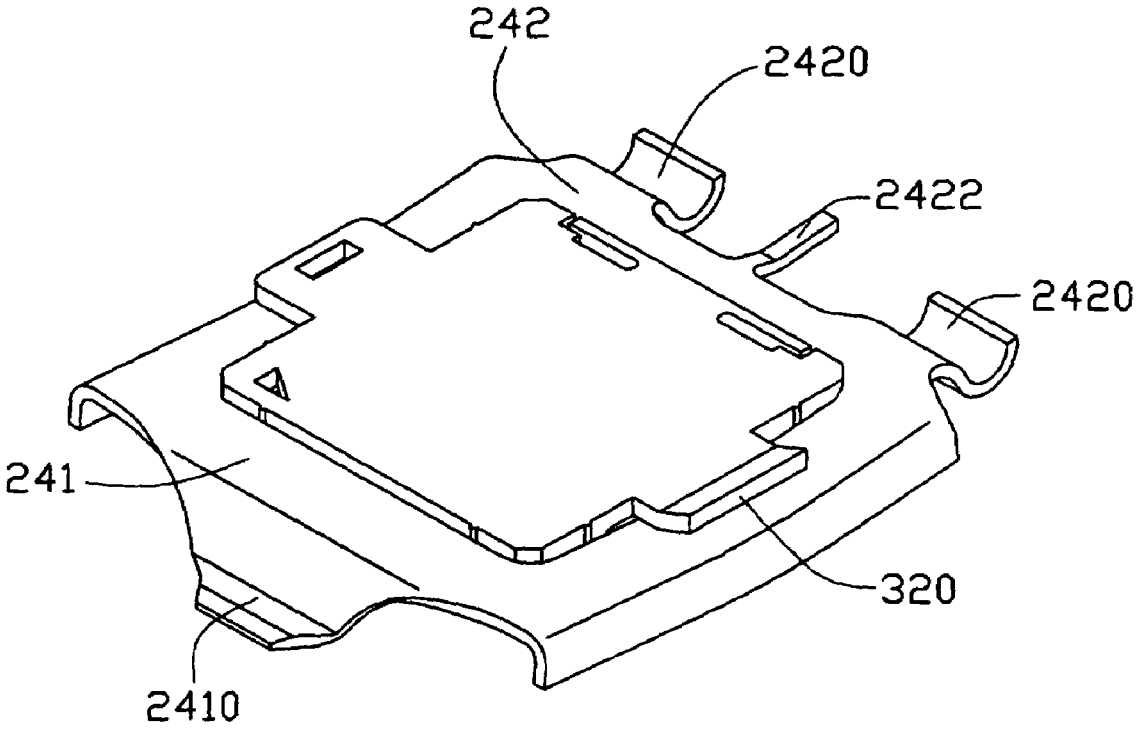
FIG. 3 is an assembled view of the pick up cap and a clip of the connector of FIG. 1, but showing from another viewing aspect.

Referring to FIGS. 3 and 4, in the course of attaching of the pick up cap 3 onto the connector 2, the pick up cap 3 is disposed over the connector 2, with the clasps 303 and latches 304 loosely contacting corresponding inner sides of the opposite ends 241, 242 of the clip 24 respectively. When the pick up cap 3 is pressed down, the clasps 303 and latches 304 are elastically deflected and snap the corresponding inner sides of two opposite ends 241, 242. At the same time, the two extending portions 32 engage firmly with two corresponding opposite urging sides 243 of the clip 24 respectively. Because the detaching portion 320 extends in a slantwise upward direction, there forms a broad rift between the detaching portion 320 and the corresponding side of the clip 24, the rift is more reliable to be noticed by the operator. After the pick up cap 3 is being mounted onto the connector 2. A vacuum suction device (not shown) can suck the top surface 300 of the pick up cap 3 in order to move the connector assembly to a pre-determined location of the PCB.

After the connector 2 is oriented at a desired location, the following step is to detach the pick up cap 3 from the connector 2. As clarified above, the rift between the detaching portion 320 and the correspond side of the clip 24 can provide a sufficient and noticeable operating space for the operator's fingertip, operator can extend one of his fingertips into the rift, and raise the detaching portion 320 to detach the pick up 3 away from the connector 2 easily and safely.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An LGA connector assembly, comprising:

an LGA connector, comprising:

an insulative housing for receiving an electronic package therein;

a clip disposed on the housing;

a pick up cap detachably mounted on the clip, the pick up cap having an extending portion, and an detaching portion extending in a slant upward direction from an end of said extending portion, between said detaching portion and one side of said clip, there is a relatively broad rift which can supply a sufficient operating place for an operator's fingertip to detach the pick up cap away from the connector.

2. The LGA connector assembly as claimed in claim 1, wherein the pick up cap has a generally rectangular planar body, opposite to the detaching portion, there is another extending portion extending laterally from another end of the planar body.

3. The LGA connector assembly as claimed in claim 2, wherein the clip defines two opposite urging sides, and the two extending portions engage with the two opposite urging sides of the clip respectively.

4. The LGA connector assembly as claimed in claim 3, wherein the middle portion of the two opposite urging sides bend downwardly.

5. The LGA connector assembly as claimed in claim 1, wherein a pair of clasps is formed at an end of the planar body, each clasp extending perpendicularly from a bottom surface for snapping a corresponding edge of the clip.

6. The LGA connector assembly as claimed in claim 5, wherein a pair of latches is formed at another end of the planar body, adjacent each latch, these is a slot setting for making the two latches to be more resilient.

7. A pick up cap for an electrical connector comprising an insulative housing, a metal clip disposed on the housing, said clip defining a window in the middle thereof, the pick up cap comprising:

a planar body defining a top surface and a bottom surface opposite to top surface;

an extending portion extending laterally from one end of the planar body; and clasps extending perpendicularly from sides of the bottom surface of the planar body;

wherein the pick up cap is mounted on the clip by the clasps snapping inner sides of the clip, a detaching portion extending from an end of the extending portion in a slant upward direction.

8. The pick up cap as claimed in claim 7, wherein opposite to the detaching porting, there is another extending portion extending laterally from another end of the planar body.

9. The pick up cap as claimed in claim 8, wherein the clip defines two opposite urging sides, the two extending portions engage with the two urging sides, between the detaching portion and one urging side, there forms a rift.

10. An electrical connector comprising:

an insulative housing;

a plurality of contacts disposed in the passageways, each of said contacts defining a surface mounting tail;

a metallic clip pivotally positioned upon the housing and defining an upward through opening therein;

a pick up cap attached onto an upper surface of the clip and covering said opening, said pick up cap including:

a large upper face for vacuum suction; and two opposite latches formed at two opposite ends of the pick up cap under said upper face to be latchably engaged with corresponding interior edges of the clip around the opening; wherein said pick up cap further includes an operating portion extending upwardly from said upper face of the pick up cap for easy operation.

11. The connector as claimed in claim 10, wherein said latches are located in a lengthwise direction of the pick up cap while said operating portion is located in a lateral direction thereof.

12. The connector as claimed in claim 11, wherein said pick up cap further includes an extension portion opposite to said operating portion in said lateral direction, and said extension portion is seated upon the clip.

13. The connector as claimed in claim 10, wherein a lateral cavity is defined by said slanted operating portion and a top surface of the clip.

14. The connector as claimed in claim 10, wherein said slanted operating portion has no concave or convex portion defined thereon.

15. The LGA connector assembly as claimed in claim 1, wherein a lateral cavity is defined by said slanted detaching portion and a top surface of the clip.

16. The LGA connector assembly as claimed in claim 1, wherein said slanted detaching portion has no concave or convex portion defined thereon.

17. The pick up cap as claimed in claim 7, wherein a lateral cavity is defined by said slanted detaching portion and a top surface of the clip.

18. The pick up cap as claimed in claim 7, wherein said slanted detaching portion has no concave or convex portion defined thereon.

19. The connector as claimed in claim 10, wherein said operating portion extends in a slanted manner.

20. The connector as claimed in claim 10, wherein the operating portion defines a smooth transition region with the upper face.

* * * * *